United States Patent [19]

Varges

[11] Patent Number: 5,038,695

[45] Date of Patent: Aug. 13, 1991

[54] ICEBREAKER

[76] Inventor: Gunter Varges, Heilsberger Str. 50, 2970 Emden, Fed. Rep. of Germany

[21] Appl. No.: 320,897

[22] Filed: Mar. 9, 1989

Related U.S. Application Data

[63] Continuation of Ser. No. 149,132, Jan. 27, 1988, abandoned.

[30] Foreign Application Priority Data

Mar. 10, 1987 [EP] European Pat. Off. ..... 87103459.1

[51] Int. Cl.[5] ..... B63B 35/08

[52] U.S. Cl. ..... 114/40; 114/56

[58] Field of Search ..... 114/40–42, 114/162, 56; D12/1, 300

[56] References Cited

U.S. PATENT DOCUMENTS 3,690,281 9/1972 Gray ..... 114/41

4,307,677 12/1981 Jastram et al. ..... 114/162 X

FOREIGN PATENT DOCUMENTS 72591 6/1979 Japan ..... 114/40

219193 11/1985 Japan ..... 114/40

*Primary Examiner*—Sherman D. Basinger

[57] ABSTRACT

For improving the headway and sternway icebreaking characteristics, the hull of a ship has the greatest width of the icebreaking waterline in the forebody and has trimming and ballasting in the stern area, whose part located above the icebreaking waterline is widened to such an extent that on lowering the afterbody by trimming or ballasting during sternway travel, a channel is broken in the ice cover, which is wider than the wide forebody part passing through said channel during sternway travel.

9 Claims, 4 Drawing Sheets

TRACK APPARATUS FOR A TOY RACING CAR

This is a continuation of copending application Ser. No. 07/295,398 filed on 1/10/87, abandoned.

BACKGROUND OF THE INVENTION

1. Field of the Invention

The present invention relates generally to a track or rail apparatus of a racing car toy which enables a toy racing car to jump.

2. Description of the Related Art

Slot car apparatuses are generally well known for racing toy cars around a laid out course. The racing car uses a motor fed by conductive lines provided in or adjacent the slot of the track. This type of car is not suitable for jumping since, when the car leaves the track, the motor looses its power source.

Another type of toy racing car has been developed wherein the racing car inertially jumps over the gap between two track segments which are spaced apart at a given interval. It is still very difficult to enable the racing car to jump to the opposite track segment and run thereon because the jumping car is inclined by the inertia of the car motor, that is, the force of stopping the car abruptly.

SUMMARY OF THE INVENTION

An object of the present invention is to provide a toy racing car and track apparatus in which the car is capable of jumping between two track segments without experiencing the problems aforementioned.

This and other objects of the invention are met by providing a track apparatus for a toy racing car which includes a track support body forming an entry-car track portion and an exit-car track portion, the two portions being sloped in opposite directions and being spaced at a given interval and having aligned ends which oppose each other, and a rotating arm pivotally supported between the two portions and being biased by a return spring to be normally juxtaposed to the entry-car track portion. The rotating arm includes magnetic materials on the top surface, a stopper to be engaged with or disengaged from the racing car in a manner to allow it to vertically move, and a stand formed to be in the same level as the car-entry and car-exit track portions when the rotating arm is rotated.

The racing car comes from the car-entry track portion to the stand connected to the end of the car-entry track portion and then stops. The rotating arm supporting the stand is inertially rotated to the car-exit track portion side. When the stand comes into contact with the end of the car-exit track portion, the stopper is moved downwardly in a manner to allow the racing car to enter the car-exit track portion.

These objects, together with other objects and advantages which will be subsequently apparent reside in the details of construction and operation of the apparatus as more fully hereinafter described and claimed, reference being had to the accompanying drawings forming a part hereof, wherein like reference numerals refer to like parts throughout.

BRIEF DESCRIPTION OF THE DRAWINGS

FIG. 1 is a perspective view showing a first preferred embodiment of the track apparatus according to the present invention;

FIG. 2 is an enlarged, partial exploded view of a portion of the embodiment of FIG. 1;

FIG. 6 is a side elevational view of a toy racing car on the stand of the embodiment of FIG. 1.

DETAILED DESCRIPTION OF THE PREFERRED EMBODIMENTS

Figure 3:
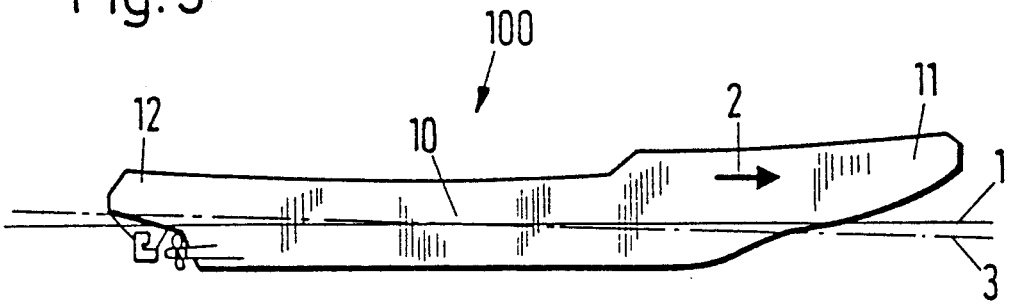
FIG. 3 is an enlarged, partial exploded view of a portion of the embodiment of FIG. 1.

As shown in FIG. 1, a track support body 1 which rests on a planar surface such as a table top or floor when the apparatus is in use includes a car-entry track portion 28 and a car-exit track portion 29 at the opposite ends of the body 1. The track portions are oppositely sloped to form take-off and landing ramps with a jumping path defined continuously therebetween. Each track portion 28 and 29 has two separate, parallel car paths, each being provided with a centrally disposed slot 4 having an associated conductor, as is typical and well known for "slot cars". Guide rails 4*a* are disposed on opposite sides of the slots 4 on the car-exit track portion 29 to help guide the cars into their respective slots.

End 29*a* of car-exit track portion 29 and end 28*a* of car-entry track portion 28 are connectable to a circular or otherwise shaped track (not shown) so as to form a segment of a race track. Connectors are not illustrated since these are well known and do not form a part of the present invention.

A base portion 5 of the track support body 1 is shaped to resemble a mountain, and the track portions 28 and 29 conform to the shape of the mountain. The sloped surface of the car-entry track portion 28 is longer and has a larger gradient than track portion 29. Also, the upper end of track segment 28 is higher than the upper end of track segment 29. The inner ends of the track portions oppose each other and are spaced apart at a selected interval.

The base portion 5 includes a supporting section on the car-entry track portion 28 side thereof which, as shown in FIG. 2, has bearings 11 integrally formed therein which support opposite ends of a shaft 12. The shaft 12 pivotally supports the proximal ends of two, side-by-side pivotal arms 6. A pair of coil springs 18 are fitted on opposite end portions of the shaft 12 between outer sides of the pivotal arms 6 and inner sides of L-shaped levers 13 pivotally supported on opposite ends of the shaft 12. Each lever 13 has a bearing aperture 14 for receiving the opposite ends of the shaft 12.

Figure 5:
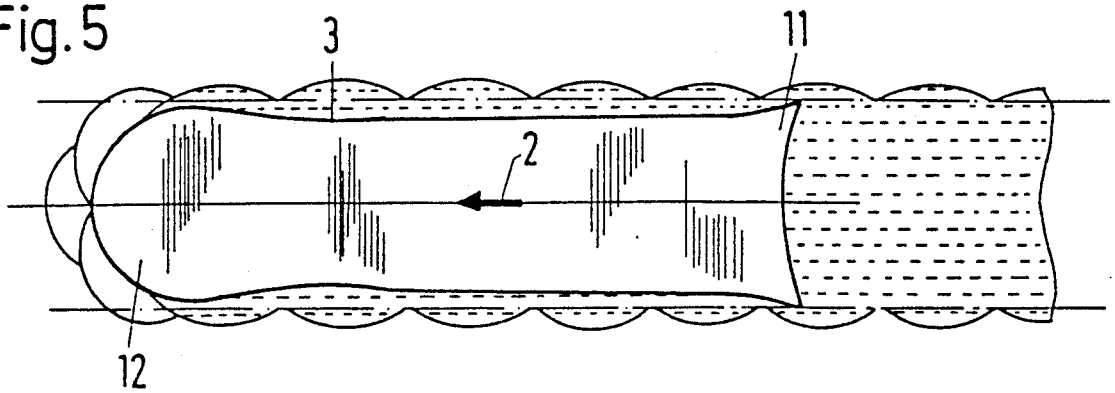
FIG. 5 is a partial sectional view showing the supporting structure for the pivoting arm of the embodiment of FIG. 1.
Figure 8:
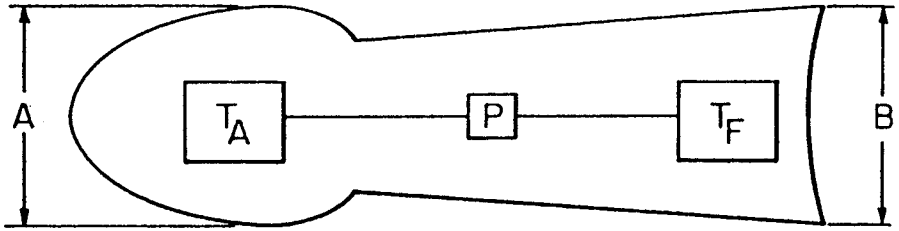

Stands 7 are mounted on the distal ends of the pivotal arms 6. When the stands 7 contact the car-entry track portion 28 as shown in FIG. 1, one end 20 (as seen in FIG. 5) of the coil spring 18 comes into contact with a pin 21 provided on the proximal end of each pivotal arm 6, and the other end 19 of the coil spring 18 comes into contact with a pin 15 provided on the lever 13. A projecting portion 16 of the lever 13 contacts a bottom plate 9*a* of the supporting structure 9. The pivotal arm 6, therefore, is forced to rotate counterclockwise as shown in FIG. 5 and can easily pivot when a racing car 26 moves onto the stand 7.

Referring to FIG. 3, each stand 7 is mounted on a distal end of the pivotal arms 6 and has a central guide

TRACK APPARATUS FOR A TOY RACING CAR

This is a continuation of copending application Ser. No. 07/295,398 filed on 1/10/87, abandoned.

BACKGROUND OF THE INVENTION

1. Field of the Invention

The present invention relates generally to a track or rail apparatus of a racing car toy which enables a toy racing car to jump.

2. Description of the Related Art

Slot car apparatuses are generally well known for racing toy cars around a laid out course. The racing car uses a motor fed by conductive lines provided in or adjacent the slot of the track. This type of car is not suitable for jumping since, when the car leaves the track, the motor looses its power source.

Another type of toy racing car has been developed wherein the racing car inertially jumps over the gap between two track segments which are spaced apart at a given interval. It is still very difficult to enable the racing car to jump to the opposite track segment and run thereon because the jumping car is inclined by the inertia of the car motor, that is, the force of stopping the car abruptly.

SUMMARY OF THE INVENTION

An object of the present invention is to provide a toy racing car and track apparatus in which the car is capable of jumping between two track segments without experiencing the problems aforementioned.

This and other objects of the invention are met by providing a track apparatus for a toy racing car which includes a track support body forming an entry-car track portion and an exit-car track portion, the two portions being sloped in opposite directions and being spaced at a given interval and having aligned ends which oppose each other, and a rotating arm pivotally supported between the two portions and being biased by a return spring to be normally juxtaposed to the entry-car track portion. The rotating arm includes magnetic materials on the top surface, a stopper to be engaged with or disengaged from the racing car in a manner to allow it to vertically move, and a stand formed to be in the same level as the car-entry and car-exit track portions when the rotating arm is rotated.

The racing car comes from the car-entry track portion to the stand connected to the end of the car-entry track portion and then stops. The rotating arm supporting the stand is inertially rotated to the car-exit track portion side. When the stand comes into contact with the end of the car-exit track portion, the stopper is moved downwardly in a manner to allow the racing car to enter the car-exit track portion.

These objects, together with other objects and advantages which will be subsequently apparent reside in the details of construction and operation of the apparatus as more fully hereinafter described and claimed, reference being had to the accompanying drawings forming a part hereof, wherein like reference numerals refer to like parts throughout.

BRIEF DESCRIPTION OF THE DRAWINGS

Figure 4:
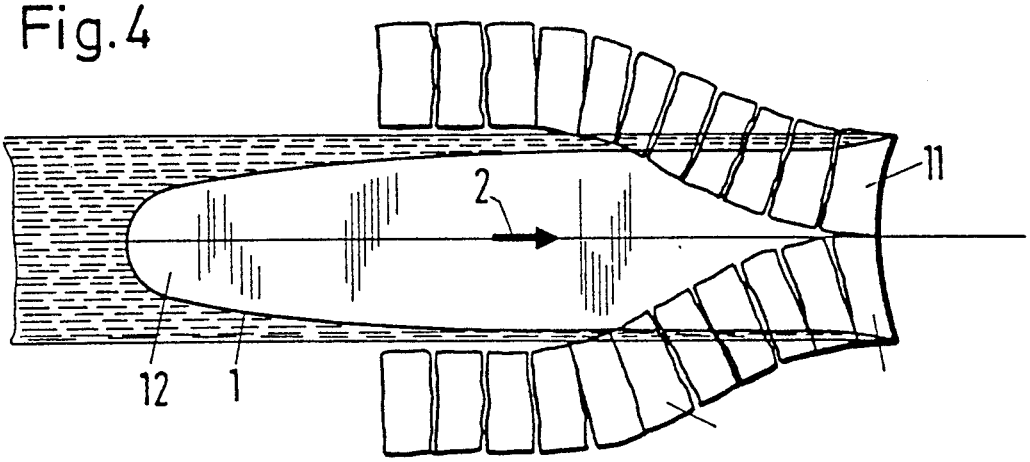
FIG. 4 is a partial side elevation view showing pivotal movement between two positions of the pivoting arm of the embodiment of FIG. 1.

FIG. 1 is a perspective view showing a first preferred embodiment of the track apparatus according to the present invention;

FIG. 2 is an enlarged, partial exploded view of a portion of the embodiment of FIG. 1;

FIG. 3 is an enlarged, partial exploded view of a portion of the embodiment of FIG. 1;

FIG. 4 is a partial side elevation view showing pivotal movement between two positions of the pivoting arm of the embodiment of FIG. 1;

FIG. 5 is a partial sectional view showing the supporting structure for the pivoting arm of the embodiment of FIG. 1; and FIG. 6 is a side elevational view of a toy racing car on the stand of the embodiment of FIG. 1.

DETAILED DESCRIPTION OF THE PREFERRED EMBODIMENTS

As shown in FIG. 1, a track support body 1 which rests on a planar surface such as a table top or floor when the apparatus is in use includes a car-entry track portion 28 and a car-exit track portion 29 at the opposite ends of the body 1. The track portions are oppositely sloped to form take-off and landing ramps with a jumping path defined continuously therebetween. Each track portion 28 and 29 has two separate, parallel car paths, each being provided with a centrally disposed slot 4 having an associated conductor, as is typical and well known for "slot cars". Guide rails 4*a* are disposed on opposite sides of the slots 4 on the car-exit track portion 29 to help guide the cars into their respective slots.

End 29*a* of car-exit track portion 29 and end 28*a* of car-entry track portion 28 are connectable to a circular or otherwise shaped track (not shown) so as to form a segment of a race track. Connectors are not illustrated since these are well known and do not form a part of the present invention.

A base portion 5 of the track support body 1 is shaped to resemble a mountain, and the track portions 28 and 29 conform to the shape of the mountain. The sloped surface of the car-entry track portion 28 is longer and has a larger gradient than track portion 29. Also, the upper end of track segment 28 is higher than the upper end of track segment 29. The inner ends of the track portions oppose each other and are spaced apart at a selected interval.

The base portion 5 includes a supporting section on the car-entry track portion 28 side thereof which, as shown in FIG. 2, has bearings 11 integrally formed therein which support opposite ends of a shaft 12. The shaft 12 pivotally supports the proximal ends of two, side-by-side pivotal arms 6. A pair of coil springs 18 are fitted on opposite end portions of the shaft 12 between outer sides of the pivotal arms 6 and inner sides of L-shaped levers 13 pivotally supported on opposite ends of the shaft 12. Each lever 13 has a bearing aperture 14 for receiving the opposite ends of the shaft 12.

Stands 7 are mounted on the distal ends of the pivotal arms 6. When the stands 7 contact the car-entry track portion 28 as shown in FIG. 1, one end 20 (as seen in FIG. 5) of the coil spring 18 comes into contact with a pin 21 provided on the proximal end of each pivotal arm 6, and the other end 19 of the coil spring 18 comes into contact with a pin 15 provided on the lever 13. A projecting portion 16 of the lever 13 contacts a bottom plate 9*a* of the supporting structure 9. The pivotal arm 6, therefore, is forced to rotate counterclockwise as shown in FIG. 5 and can easily pivot when a racing car 26 moves onto the stand 7.

Referring to FIG. 3, each stand 7 is mounted on a distal end of the pivotal arms 6 and has a central guide

TRACK APPARATUS FOR A TOY RACING CAR

This is a continuation of copending application Ser. No. 07/295,398 filed on 1/10/87, abandoned.

BACKGROUND OF THE INVENTION

1. Field of the Invention

The present invention relates generally to a track or rail apparatus of a racing car toy which enables a toy racing car to jump.

2. Description of the Related Art

Slot car apparatuses are generally well known for racing toy cars around a laid out course. The racing car uses a motor fed by conductive lines provided in or adjacent the slot of the track. This type of car is not suitable for jumping since, when the car leaves the track, the motor looses its power source.

Another type of toy racing car has been developed wherein the racing car inertially jumps over the gap between two track segments which are spaced apart at a given interval. It is still very difficult to enable the racing car to jump to the opposite track segment and run thereon because the jumping car is inclined by the inertia of the car motor, that is, the force of stopping the car abruptly.

SUMMARY OF THE INVENTION

An object of the present invention is to provide a toy racing car and track apparatus in which the car is capable of jumping between two track segments without experiencing the problems aforementioned.

This and other objects of the invention are met by providing a track apparatus for a toy racing car which includes a track support body forming an entry-car track portion and an exit-car track portion, the two portions being sloped in opposite directions and being spaced at a given interval and having aligned ends which oppose each other, and a rotating arm pivotally supported between the two portions and being biased by a return spring to be normally juxtaposed to the entry-car track portion. The rotating arm includes magnetic materials on the top surface, a stopper to be engaged with or disengaged from the racing car in a manner to allow it to vertically move, and a stand formed to be in the same level as the car-entry and car-exit track portions when the rotating arm is rotated.

The racing car comes from the car-entry track portion to the stand connected to the end of the car-entry track portion and then stops. The rotating arm supporting the stand is inertially rotated to the car-exit track portion side. When the stand comes into contact with the end of the car-exit track portion, the stopper is moved downwardly in a manner to allow the racing car to enter the car-exit track portion.

These objects, together with other objects and advantages which will be subsequently apparent reside in the details of construction and operation of the apparatus as more fully hereinafter described and claimed, reference being had to the accompanying drawings forming a part hereof, wherein like reference numerals refer to like parts throughout.

BRIEF DESCRIPTION OF THE DRAWINGS

FIG. 1 is a perspective view showing a first preferred embodiment of the track apparatus according to the present invention;

FIG. 2 is an enlarged, partial exploded view of a portion of the embodiment of FIG. 1;

FIG. 3 is an enlarged, partial exploded view of a portion of the embodiment of FIG. 1;

FIG. 4 is a partial side elevation view showing pivotal movement between two positions of the pivoting arm of the embodiment of FIG. 1;

FIG. 5 is a partial sectional view showing the supporting structure for the pivoting arm of the embodiment of FIG. 1; and FIG. 6 is a side elevational view of a toy racing car on the stand of the embodiment of FIG. 1.

DETAILED DESCRIPTION OF THE PREFERRED EMBODIMENTS

As shown in FIG. 1, a track support body 1 which rests on a planar surface such as a table top or floor when the apparatus is in use includes a car-entry track portion 28 and a car-exit track portion 29 at the opposite ends of the body 1. The track portions are oppositely sloped to form take-off and landing ramps with a jumping path defined continuously therebetween. Each track portion 28 and 29 has two separate, parallel car paths, each being provided with a centrally disposed slot 4 having an associated conductor, as is typical and well known for "slot cars". Guide rails 4*a* are disposed on opposite sides of the slots 4 on the car-exit track portion 29 to help guide the cars into their respective slots.

End 29*a* of car-exit track portion 29 and end 28*a* of car-entry track portion 28 are connectable to a circular or otherwise shaped track (not shown) so as to form a segment of a race track. Connectors are not illustrated since these are well known and do not form a part of the present invention.

A base portion 5 of the track support body 1 is shaped to resemble a mountain, and the track portions 28 and 29 conform to the shape of the mountain. The sloped surface of the car-entry track portion 28 is longer and has a larger gradient than track portion 29. Also, the upper end of track segment 28 is higher than the upper end of track segment 29. The inner ends of the track portions oppose each other and are spaced apart at a selected interval.

The base portion 5 includes a supporting section on the car-entry track portion 28 side thereof which, as shown in FIG. 2, has bearings 11 integrally formed therein which support opposite ends of a shaft 12. The shaft 12 pivotally supports the proximal ends of two, side-by-side pivotal arms 6. A pair of coil springs 18 are fitted on opposite end portions of the shaft 12 between outer sides of the pivotal arms 6 and inner sides of L-shaped levers 13 pivotally supported on opposite ends of the shaft 12. Each lever 13 has a bearing aperture 14 for receiving the opposite ends of the shaft 12.

Stands 7 are mounted on the distal ends of the pivotal arms 6. When the stands 7 contact the car-entry track portion 28 as shown in FIG. 1, one end 20 (as seen in FIG. 5) of the coil spring 18 comes into contact with a pin 21 provided on the proximal end of each pivotal arm 6, and the other end 19 of the coil spring 18 comes into contact with a pin 15 provided on the lever 13. A projecting portion 16 of the lever 13 contacts a bottom plate 9*a* of the supporting structure 9. The pivotal arm 6, therefore, is forced to rotate counterclockwise as shown in FIG. 5 and can easily pivot when a racing car 26 moves onto the stand 7.

Referring to FIG. 3, each stand 7 is mounted on a distal end of the pivotal arms 6 and has a central guide slot 2*a* which is rounded at the outer end. Magnetic strips 22 are provided on opposite sides of the guide slots 2*a* at the same width apart as the conductors 2 provided on opposite sides of slots 4. A pair of magnetic strips 22 for a pivotal arm 6 will attract a magnet 27 provided in the racing car 26.

A through hole 23 is formed at a forward portion of each stand 7 to receive a stopper 24, as will be described below. Each stand 7 is substantially coplanar with the other and angularly moves independent of each other in parallel paths to each other between a first or starting position as illustrated in FIG. 1, where the stand is in line with the inside end of the car-entry track portion 28, and a second or end position, where the stand is in line with the inside end of the car-exit portion 29. The range of angular movement is illustrated in FIG. 4.

Each pivotal arm 6 supports a sliding rod 8 which extends longitudinally. The aforementioned stopper 24 is formed on the distal end of each sliding rod 8 so as to freely move in or out of the through hole 23. Each sliding rod has a stub 8*a* (FIG. 2) mounting one end of tension springs 17, while the opposite end of each tension spring 17 is mounted on a stub 6*a* formed on a lower portion of the two pivotal arms 6. The springs bias the sliding rods 8 towards the lower portion of the respective pivotal arms. The proximal ends of the sliding rods 8 will thus be in contact with the bottom plate 9*a* of the supporting structure 9.

As shown in FIG. 6, a chassis of the racing car 27, shown on the stand 7, supports current collecting shoes or brushes 25 at a forward portion of the car 27, and further supports the magnet 27. The magnet 27 attracts the magnetic strips 22 disposed on each stand 7 so as to allow the racing car 26 to be held magnetically thereon. Although there is specific provision for a magnet 27, it is possible in an alternative embodiment to use instead the magnetic force of the magnets of the car's electric motor which is mounted on the chassis.

As aforementioned, the car-entry track portion 28 extends longer and at a larger gradient. The racing car 26 runs into the track portion 28 from an attached track at a high speed and comes to the stand 7, where it is stopped by the stopper 24. The pivotal arm 6 is then inertially forced to pivot from the first position to the second position due to the momentum of the car 26. The car's momentum carries the car and its pivotal arm 6 to the car-exit track portion 29. After passing the apex of its angular movement path, the cars weight and the weight of the pivotal arm 6 help complete the angular movement to the inner end of the car-exit track portion 29. At this position, the pivotal arm 6 is angled towards the car-exit track portion 29 to a greater degree from vertical than it was originally inclined towards the car-entry track portion 28. As shown in FIG. 4, this greater angle permits the sliding rod 8 to slide further downwardly, thereby retracting the stopper 24 from the stand 7. Thus, with the front end of the stand 7 in abutment with the inner end of car-exit track portion 29, the car 26 will pass from the stand to the car-exit track portion 29.

Each slot 4 of the car-exit track portion 29 has a V-shaped cut-away portion 3 on the inner end thereof so as to guide the guide pin 26*a* of the racing car 26.

When the pivoting arm 6 has pivoted so as to move the stand 7 into abutment with the inner end of the car-exit track portion 29, the coil springs 18 are caused to be tensioned by expanding the distance between the spring ends 19 and 29. This is due to the fact that upon counterclockwise movement of the arm 6, the ends 19 and 20 of each spring abut pin 21 of the lever 13 and pin 15 of the pivotal arm 6, respectively. This creates a return-spring bias which causes the pivotal arm 6 to pivot back to its original position depicted in FIG. 1 after the stand 7 has made contact with the car-exit track portion 29. This feature can be better understood referring to FIG. 5. The ends 19 and 20 of the spring 18 normally retain the projecting portion 16 in an orthogonal position relative to the pivotal arm 6. Once the arm 6 has moved to the right (clockwise) to a disposition of less than 90°, the weight of the arm will cause the stand 7 to rest against the forward, inner end of the car-entry track portion 28. Thus, the springs 18 need only move the arm 6 clockwise to a point less than 90°, or to the right of vertical. When the arm 6 moves counterclockwise due to the momentum of the car 26, the lever 13 pivots with arm until the projecting portion 16 contacts abutment 30, whereupon the lever is prevented from further rotation. As the arm continues to rotate the angle between the arm 6 and the projecting portion 16 becomes increasingly obtuse, and the spring tension in the coil springs 18 builds.

As further evidenced by FIG. 5, no spring force is developed for the first few degrees of angular movement until the projection portion 16 contacts the abutment 30. For the next few degrees, no spring force is developed until pin 21 contacts spring end 19 and pin 15 abuts spring end 20. This occurs when the arm is nearly vertical, but not quite. Thereafter, spring force is developed to cause the return of the arm 6. The aforementioned arrangement prevents excessive spring force which would exceed the inertial arm pivoting force and thereby prevent the car from passing from the car-entry to the car-exit tract portion 29.

The many features and advantages of the present invention are apparent from the detailed specification, and thus, it is intended by the appended claims to cover all such features and advantages of the track or rail apparatus of a racing car toy which fall within the true spirit and scope of the invention. Further, since numerous modifications and changes will readily occur to those skilled in the art based upon the disclosure herein, it is not desired to limit the invention to the exact construction and operation illustrated and described. Accordingly, all suitable modifications and equivalents may be resorted to, falling within the scope and the spirit of the invention.

What is claimed:

1. A track apparatus for a toy racing car comprising:

a track support body having a car-entry track portion at one end and a car-exit track portion at the opposite end;

at least one pivotal arm means pivotally movable between a first position juxtaposed the car-entry track portion and a second position juxtaposed the car-exit track portion, and being movable between the first and second positions by momentum of a toy racing car, and having a distal end and a proximal end pivotally connected to the track support body between the car-entry track portion and the car-exit track portion;

a stand connected to the distal end of each at least one pivotal arm means;

means associated with the stand for transferring the momentum of the car to each at least one pivotal arm means to thereby cause pivotal movement of 5. An icebreaker according to claim 4, wherein rotor rudders are used as the high-performance rudders.

6. An icebreaker according to claim 5, wherein in the vicinity of the afterbody of the hull breaking shoulders are provided on either side.

7. An icebreaker according to claim 6, wherein in the vicinity of its breaking shoulders, the afterbody of the hull has a greater width than the forebody.

8. An icebreaker boat hull having a forebody, a midsection, and an afterbody, said hull having a normal water line defining a horizontal plane when the boat is not under power, trimming and ballasting means in the hull to alter said normal water line relative to the actual water line to increase the draught of the hull forebody during forward hull movement, said trimming and ballasting means also increasing the draught of the hull afterbody-during sternwise travel of the boat, said hull forebody so shaped that the hull forebody has a wider beam above said normal water line, said hull afterbody so shaped that the hull afterbody has a wider beam above said normal water line, and said hull midsection having a beam less than that of said forebody and less than that of said after body, and shoulder portions of said afterbody adjacent said hull midsection.

9. The icebreaker hull construction of claim 8 wherein the hull afterbody has a maximum width at least as great as that of the maximum width of the hull forebody.

* * * * *